US009068497B2

(12) United States Patent
Anderson et al.

(10) Patent No.: US 9,068,497 B2
(45) Date of Patent: Jun. 30, 2015

(54) OIL SUPPLY SYSTEM FOR AN ENGINE

(75) Inventors: Stephen Anderson, Benfleet (GB); Steve Garrett, Kidwelly (GB)

(73) Assignee: Ford Global Technologies, LLC, Dearborn, MI (US)

( * ) Notice: Subject to any disclaimer, the term of this patent is extended or adjusted under 35 U.S.C. 154(b) by 316 days.

(21) Appl. No.: 13/112,167

(22) Filed: May 20, 2011

(65) Prior Publication Data

US 2011/0283968 A1 Nov. 24, 2011

(30) Foreign Application Priority Data

May 20, 2010 (GB) ..... 1008394.7

(51) Int. Cl.

*F01M 11/02* (2006.01)
*F01P 7/02* (2006.01)
*F01P 1/04* (2006.01)

(Continued)

(52) U.S. Cl.

CPC ... *F01P 3/06* (2013.01); *F01P 5/08* (2013.01); *F01M 9/10* (2013.01); *F02B 67/04* (2013.01); *F02B 2075/027* (2013.01); *F01M 11/02* (2013.01); *F01M 3/04* (2013.01); *F01M 1/08* (2013.01); *F01M 2250/62* (2013.01); *F01M 2250/64* (2013.01)

(58) Field of Classification Search

CPC ..... F01M 11/02; F01M 1/02; F01M 3/04; F01M 9/10; F02B 2075/027; F02B 67/04; F02B 3/06; F02B 2075/025; F01P 5/08; F01P 7/023; B64D 33/08; B64D 2700/62973

USPC ..... 123/196 R, 41.58, 41.64, 41.35, 41.05, 123/41.04

See application file for complete search history.

(56) References Cited

U.S. PATENT DOCUMENTS 4,204,487 A * 5/1980 Jones ..... 123/41.35
4,825,826 A 5/1989 Andres (Continued)

FOREIGN PATENT DOCUMENTS

CN 2584845 Y 11/2003
DE 102005022460 A1 11/2006

(Continued)

OTHER PUBLICATIONS

Neumann et al., "The New 1,9 L TDI Diesel Engine With Low Fuel Consumption and Low Emission from Volkswagen and Audi," SAE Technical Paper Series No. 923034, Jan. 5, 1992, 17 Pages.

(Continued)

*Primary Examiner* — Lindsay Low
*Assistant Examiner* — Syed O Hasan
(74) *Attorney, Agent, or Firm* — Julia Voutyras; Alleman Hall McCoy Russell & Tuttle LLP

(57) ABSTRACT

An oil supply system for a reciprocating piston internal combustion engine is disclosed in which the supply of oil to piston cooling jets is controlled by pressure operated valves designed to open at a pre-defined valve opening pressure. The pressure of oil supplied by a pump is controlled to be below this pre-defined valve opening pressure during operation of the engine in which piston cooling is not required, and the pressure of oil is controlled to above the pre-defined valve opening pressure when piston cooling is required. The control of the pump is by an electronic control unit based upon a combination of engine speed and engine load.

18 Claims, 8 Drawing Sheets

(51) Int. Cl.

| | |
|---|---|
| ***F01P 3/06*** | (2006.01) |
| ***F01M 1/08*** | (2006.01) |
| *F01P 5/08* | (2006.01) |
| *F01M 9/10* | (2006.01) |
| *F02B 67/04* | (2006.01) |
| *F02B 75/02* | (2006.01) |
| *F01M 3/04* | (2006.01) |

(56) References Cited

U.S. PATENT DOCUMENTS

| | | | | |
|---|---|---|---|---|
| 5,819,692 | A | 10/1998 | Schafer | |
| 7,018,178 | B2 * | 3/2006 | Hunter et al. | 417/219 |
| 7,322,318 | B2 * | 1/2008 | Nagahashi et al. | 123/41.35 |
| 7,600,463 | B2 * | 10/2009 | Kooriyama | 91/516 |
| 7,819,093 | B2 * | 10/2010 | Yamashita et al. | 123/41.35 |
| 2002/0172604 | A1 | 11/2002 | Berger | |
| 2005/0120982 | A1 * | 6/2005 | Ducu | 123/41.08 |
| 2008/0308353 | A1 | 12/2008 | Aixala | |
| 2009/0229561 | A1 | 9/2009 | Yamashita et al. | |
| 2010/0001103 | A1 | 1/2010 | Neto et al. | |
| 2011/0144882 | A1 | 6/2011 | Bidner et al. | |

FOREIGN PATENT DOCUMENTS

| | | | |
|---|---|---|---|
| JP | 7241718 | A | 9/1995 |
| JP | 8270443 | A | 10/1996 |
| JP | 10212916 | A | 8/1998 |
| JP | 2005324907 | A | 11/2005 |
| KR | 20020043092 | A | 6/2002 |
| KR | 20040029739 | A | 4/2004 |
| KR | 20080055361 | A | 6/2008 |

OTHER PUBLICATIONS

Elsbett, L. et al., "Elko's High Performance 1.4 Liter 65 Kw 3 Cylinder Turbocharged Direct Injection Diesel Engine," SAE Technical Paper Series No. 825019, Jan. 1, 1982, 8 Pages.

ISA Great Britain Intellectual Property Office, Search Report of GB1008394.7, Sep. 10, 2010, 3 pages.

Partial Translation of Office Action of Chinese Application No. 201110129861.X, Issued Sep. 1, 2014, State Intellectual Property Office of PRC, 11 Pages.

* cited by examiner

OIL SUPPLY SYSTEM FOR AN ENGINE

RELATED APPLICATIONS

This application claims priority to United Kingdom Patent Application No. 1008394.7, filed May 20, 2010, the entire contents of which being incorporated herein by reference.

FIELD

The present disclosure relates to systems and methods for supplying oil in a reciprocating piston internal engine.

BACKGROUND AND SUMMARY

It is well known to provide an oil supply system for an engine that supplies oil from a reservoir, often referred to as a sump, to various components on the engine requiring a supply of oil, such as bearings, pistons, hydraulic valve mechanisms, and piston cooling jets.

However, the inventors herein have identified a number of issues with the above approach. The flow of oil is not based upon the operating state of the engine, and so at times a high flow of oil is provided when in fact a lower flow of oil would be adequate, causing an oversupply of oil that uses unnecessary power, and so has a negative effect on fuel economy.

It is a particular problem in respect to the use of piston cooling jets that if oil is supplied to the pistons to cool them when the engine is operating at low load, overcooling of the pistons can take place, which has an adverse effect on fuel economy as well as requiring the circulation of a greater volume of oil than would otherwise be necessary to meet the lubrication needs of the engine, thereby further reducing fuel economy.

Accordingly, systems and methods are disclosed herein to at least partially address the above issues. One embodiment includes a method for controlling oil flow in an engine. The method comprises adjusting oil pressure inversely with engine speed by adjusting a solenoid valve hydraulically coupled with an oil pump, and selectively routing oil through an oil galley to a piston cooling jet via a pressure-operated valve responsive to the adjusted oil pressure. Responsive to identified degradation of the solenoid valve, the pressure may be increased irrespective of engine speed to supply oil cooling jet operation.

Another embodiment includes an oil supply system for a reciprocating piston internal combustion engine, the system comprising an electronic control unit, an oil reservoir, a pump to supply oil at pressure from the reservoir to components including at least one piston cooling jet requiring a supply of oil, and at least one pressure-operated valve to supply oil to the at least one piston cooling jet, each pressure-operated valve coupled to one piston cooling jet and configured to open at a predefined valve opening pressure. Each piston cooling jet may be supplied with oil through a pressure operated valve, and the pump may be operable to supply oil in a low pressure mode of operation at a first predefined pressure below the predefined valve opening pressure and to supply oil in a high pressure mode at a second predefined pressure above the predefined valve opening pressure. The electronic control unit is operable to select the operating mode of the pump based upon a predefined relationship between engine speed and engine load.

The piston cooling jets may be supplied with oil when oil pressure is above a threshold. The oil pressure may be determined by a combination of engine speed and load such that during certain operating conditions, the piston jets receive oil that is in turn supplied to the pistons of the engine to provide cooling, while during other operating conditions, the piston jets do not receive oil and thus the pistons are not cooled. In this manner, the oil supply system is operable to match oil supply to the operating conditions of the engine so as to reduce fuel usage. Further, the pressure output by the oil pump may be adjusted by adjusting a solenoid valve coupled to the pump. The oil pump and solenoid valve are configured to output high pressure oil in response to a degradation of the solenoid valve, such that the pistons may be cooled even if a failure in the solenoid valve occurs.

DETAILED DESCRIPTION

Figure 1:
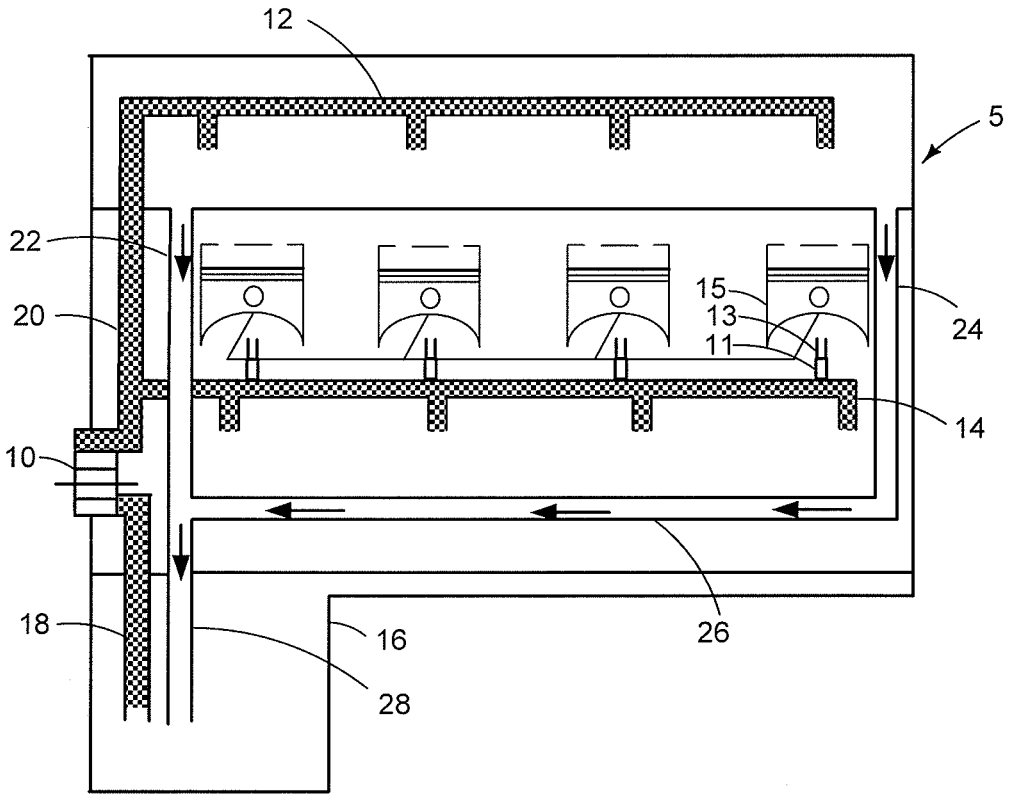
FIG. 1 is a scrap cutaway view of a reciprocating piston internal combustion engine having an oil supply system according to an embodiment of the disclosure.

The following description relates to systems and methods for controlling oil flow to one or more piston cooling jets in an engine, such as the engine depicted in FIG. 1, and to an engine having an oil supply system of the present disclosure. Various components of the oil system for controlling oil flow to the piston cooling jets are depicted in FIGS. 2-6. The control of the flow of oil may be based on a predefined relationship between engine speed and load, as shown in the example charts of FIGS. 7-9. A method for controlling the flow of oil that may be carried out by a controller of the engine is depicted in FIG. 10.

Turning to FIG. 1 of the drawings, a schematic depiction of engine 5 includes multiple cylinders and an oil supply system. While four cylinders are depicted in FIG. 1, it is to be understood that any number of cylinders is within the scope of this disclosure.

The oil supply system includes an engine driven circulation pump 10 for supplying oil from a reservoir such as sump 16 to an oil supply circuit. The oil pump 10 has a suction pipe 18 drawing oil from the sump 16 of the engine and has a delivery pipe 20 that discharges into a head oil galley 12 and a main oil galley 14, forming part of the oil supply circuit of the engine 5.

The head galley 12 is arranged in a cylinder head of the engine 5 and delivers oil to the surfaces in the cylinder head that require lubrication and cooling, notably all the surfaces associated with the valve train such as camshaft bearings, cams, followers, hydraulic tappets etc. The oil from the cylinder head falls under gravity through two drainage holes 22 and 24 back into the sump 16 via return passages 26 and 28. The oil from the main galley 14 falls under gravity via a crankcase of the engine 5 back into the sump 16.

An oil filter (not shown on FIG. 1) can be arranged between the pump 10 and the oil galleys 12 and 14, and in some embodiments, an oil-to-coolant heat exchanger (not shown on FIG. 1) can be provided. The effect of the heat exchanger is to increase the speed of warm up of the oil when the engine 5 is started from cold while ensuring that the oil does not overheat during normal operation.

Four piston cooling jets 13 are connected to the main galley 14 via respective pressure operated valves 11. Each of the cooling jets 13 is operable to selectively supply a jet of oil onto a lower face of a respective piston 15 when cooling of the piston is required. It will be appreciated that there could be more than one piston cooling jet 13 provided for each piston but in each case the oil supply to each piston cooling jet 13 is via a respective pressure operated valve 11 coupled the piston cooling jet 13. The piston cooling jet in some embodiments supplies oil to an oil galley within each piston.

Each of the pressure operated valves 11 is a simple mechanical valve arranged to open at a pre-defined valve opening pressure so that, when the pressure of the oil in the main galley 14 is below this pre-defined pressure, there is no flow of oil to the cooling jets 13 and, when the pressure in the main galley 14 is above the pre-defined pressure, oil is supplied to the piston cooling jets so as to cool the pistons of the engine 5.

The pump 10 is controlled by an electronic control unit (such as ECU 50 of FIGS. 5 and 6) so as to provide two distinct oil supply system operating modes. In the first of these modes known as a 'low pressure operating mode' the pump 10 is operated so as to produce an oil pressure in the main galley 14 below the pre-defined valve opening pressure so that the piston cooling jets 13 are switched off. In the second operating mode known as a 'high pressure operating mode' the pump 10 is controlled so as to produce an oil pressure in the main galley 14 greater than the predefined valve opening pressure. See FIG. 7 where the relationship of the low and high pressure operating modes with respect to the predefined valve opening pressure (piston cooling jet oil pressure threshold) is shown. Note that, because the pump 10 is in this case engine driven, for very low engine speeds the pressure is below the predefined valve opening pressure irrespective of the operating mode selected.

For example and without limitation, if the predefined valve opening pressure is 350 kPa, in the low pressure mode of operation, the oil pressure in the main galley 14 may be 250 kPA, and in the high pressure mode of operation the oil pressure in the main galley 14 may be 450 kPA. In this way, the operating pressure of the engine 5 can be used to switch on and off the cooling jets 13. The electronic control unit is programmed so as to control the operating pressure of the engine 5 based upon one or more maps or look up tables relating operating speed and engine torque/load. A relationship between engine speed and load is established by experimental work defining a switching point between the two operating modes for the full range of operating speed and torque output of the engine and this data is stored in a map or look up table and is used by the electronic control unit to determine in which operating mode the oil supply system is to operate. It will be appreciated that in order to make this determination the electronic control unit receives information from sensors indicative of at least the current engine speed and a parameter indicative of engine load such as, for example, throttle pedal position. Therefore, for any engine speed and engine load combination the electronic control unit is operable to select the appropriate operating mode.

In general terms the high pressure operating mode is selected when the engine 5 is operating at high speed and at a moderate to high load and the low pressure operating mode is selected when the engine is operating at low speed or at low load. In this way the pump 10 is absorbing a high level of power when it is actually required to cool the pistons, thereby reducing fuel usage by the engine 5. In addition, because the cooling jets 13 are only 'on' when cooling is required during high load/high speed operation of the engine 5, the risk of piston overcooling is reduced.

It will be appreciated that the oil pump could be driven by an electric motor and not directly by the engine 5. In such a case the pressure could be controlled by varying the speed of the pump under the control of the electronic control unit in response to a pressure feedback from the main galley 14. It will be further appreciated that some embodiments are applicable to engines having any method of driving the oil pump and are not limited to a belt-driven oil pump.

Figure 2:
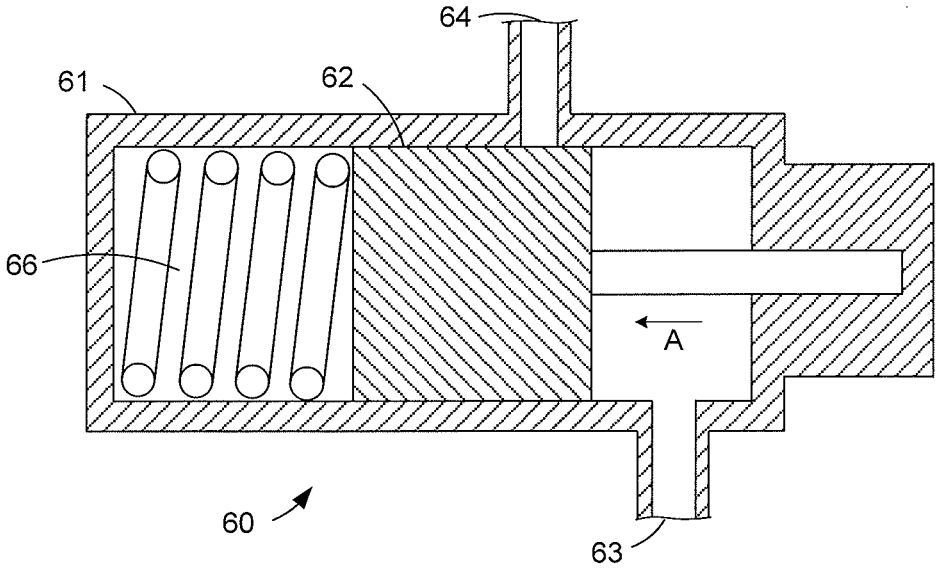
FIG. 2 is a cross-section through an embodiment of a pressure operated valve for use in an oil supply system according to the disclosure.

A first embodiment of a pressure operated valve is shown in FIG. 2, where it can be seen that a pressure operated valve 60 has a housing 61 defining a cylindrical chamber in which is slidingly supported a piston 62. A spring 66 acts upon one end of the piston 62 so as to bias it into a valve closed position, as shown on FIG. 2. The piston 62 blocks an outlet 64 thereby preventing oil at pressure from passing through an inlet 63, through the pressure operated valve 60, to the outlet 64 and then on to one or more piston cooling jets (not shown). When the pressure in the inlet 63 exceeds a predetermined valve opening pressure, the pressure of the oil acting on the piston 62 is sufficient to displace the piston 62 against the action of the spring 66 thereby opening the flow of oil from the inlet 63 to the outlet 64 and allowing oil to flow to one or more piston cooling jets (not shown).

Figure 3:
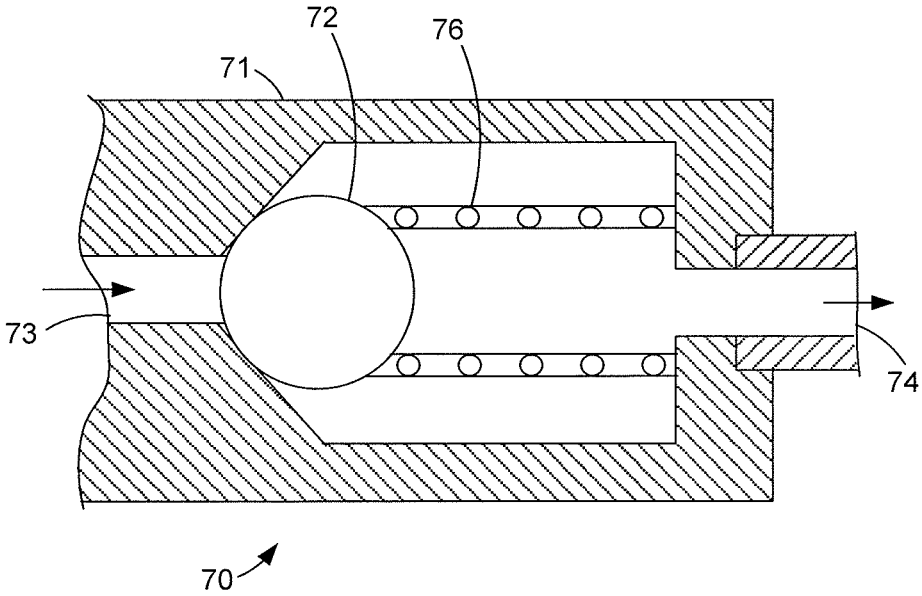
FIG. 3 is a cross-section through another embodiment of a pressure operated valve for use in an oil supply system according to the disclosure.

A second embodiment of a pressure operated valve is shown in FIG. 3. A pressure operated valve 70 has a housing 71 defining a cylindrical chamber in which a valve member in the form of a ball 72 is slidingly supported. A spring 76 acts upon the ball 72 so as to bias it into a closed position as shown, where the piston ball 72 blocks an inlet 73, thereby preventing oil at pressure from passing through the pressure operated valve 70 to an outlet 74 and then on to one or more piston cooling jets (not shown). When the pressure in the inlet 73 exceeds a predetermined valve opening pressure, the pressure of the oil acting on the ball 72 is sufficient to displace it against the action of the spring 76, thereby opening the flow of oil from the inlet 73 to the outlet 74 and allowing oil to flow to one or more piston cooling jets (not shown). The application of a similar pressure operated valve is disclosed in US Patent publication 2010/0001103.

Referring now to FIGS. 4 to 9 the control of oil supply circuit pressure for one embodiment of the disclosure will be described in greater detail.

Figure 4:
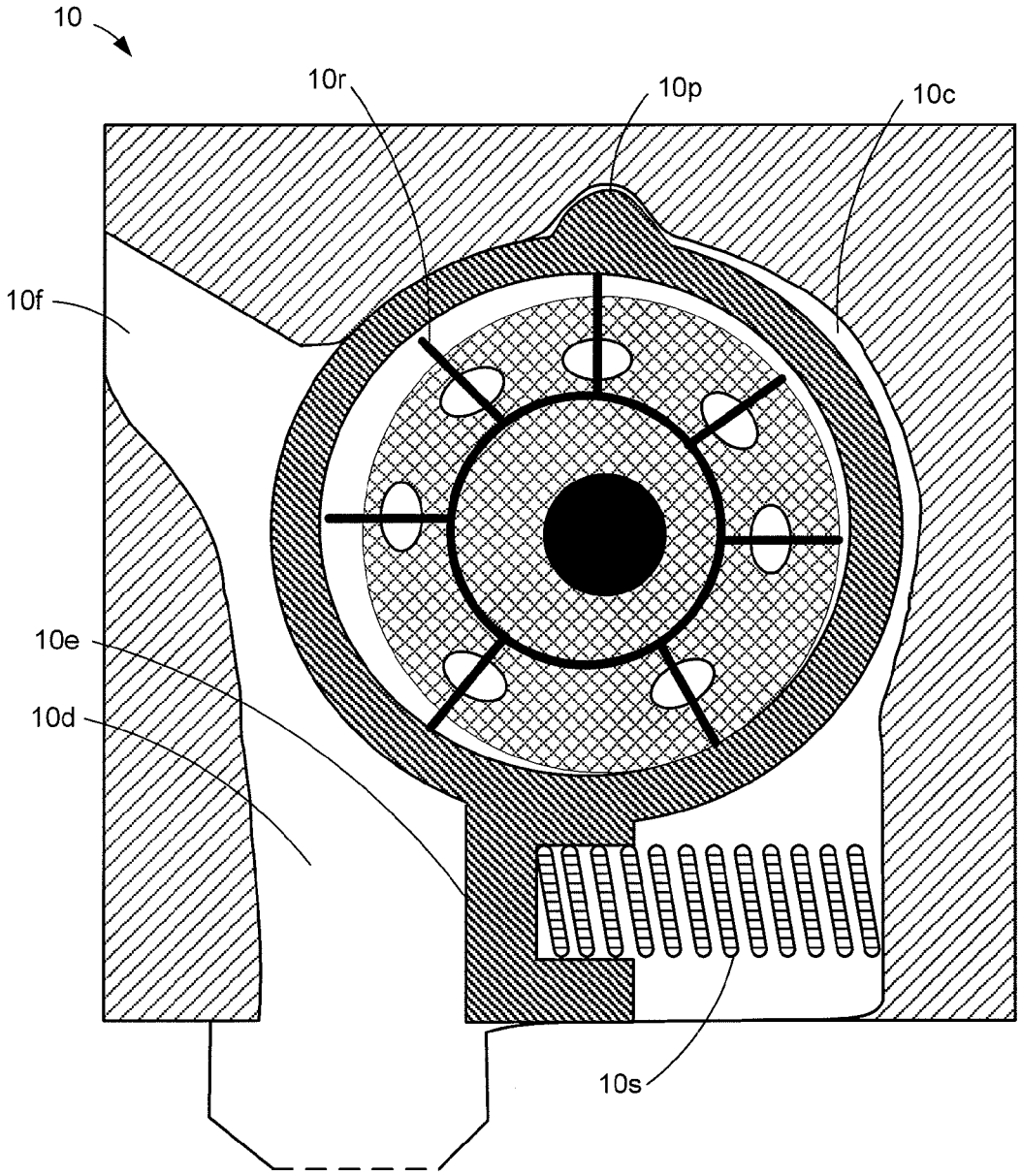
FIG. 4 is a cross-section through a variable flow rate oil pump for use in an oil supply system according to the disclosure.

FIG. 4 shows in greater detail the variable flow rate oil pump 10 shown on FIG. 1. The pump 10 is driven by the engine 5 via a belt drive (not shown). Oil pressure output is regulated by an oil pressure return from a pressure feedback port 10*f* acting on a vane control ring 10*c*. The oil from the pressure feedback port 10*f* is transferred to a control chamber 10*d* where it reacts against a control member 10*e*. A vane rotor 10*r* is rotatably mounted in the vane control ring 10*c* and the vane control ring 10*c* is pivotally supported at an upper end by a pivot member 10*p* which reacts against part of a housing for the pump 10. A calibrated pressure control spring 10*s* acts so as to bias the control member 10*e* against the action of the pressure in the control chamber 10*d*. The balance of the oil pressure force versus the pressure control spring 10*s* force changes the eccentricity of the vane rotor 10*r* by pivoting the control ring 10*c* about the pivot member 10*p* such that when the pressure in the control chamber 10*d* increases, the flow output is reduced and hence the pressure in the oil supply circuit of the engine 5 is reduced. Reducing the pressure in the control chamber 10*d* increases the eccentricity thereby increasing the pressure. The pump 10 is shown in FIG. 1 in a maximum eccentricity position with no feedback pressure applied. An over pressure valve 'OV' (shown on FIGS. 5 and 6) will open on cold start condition when the oil flow rate is low and the delay in returning oil though the pressure feedback port 10*f* is long, thereby allowing oil return directly to the sump 16 via a return line 'RL' (shown on FIGS. 5 and 6).

Figure 5:
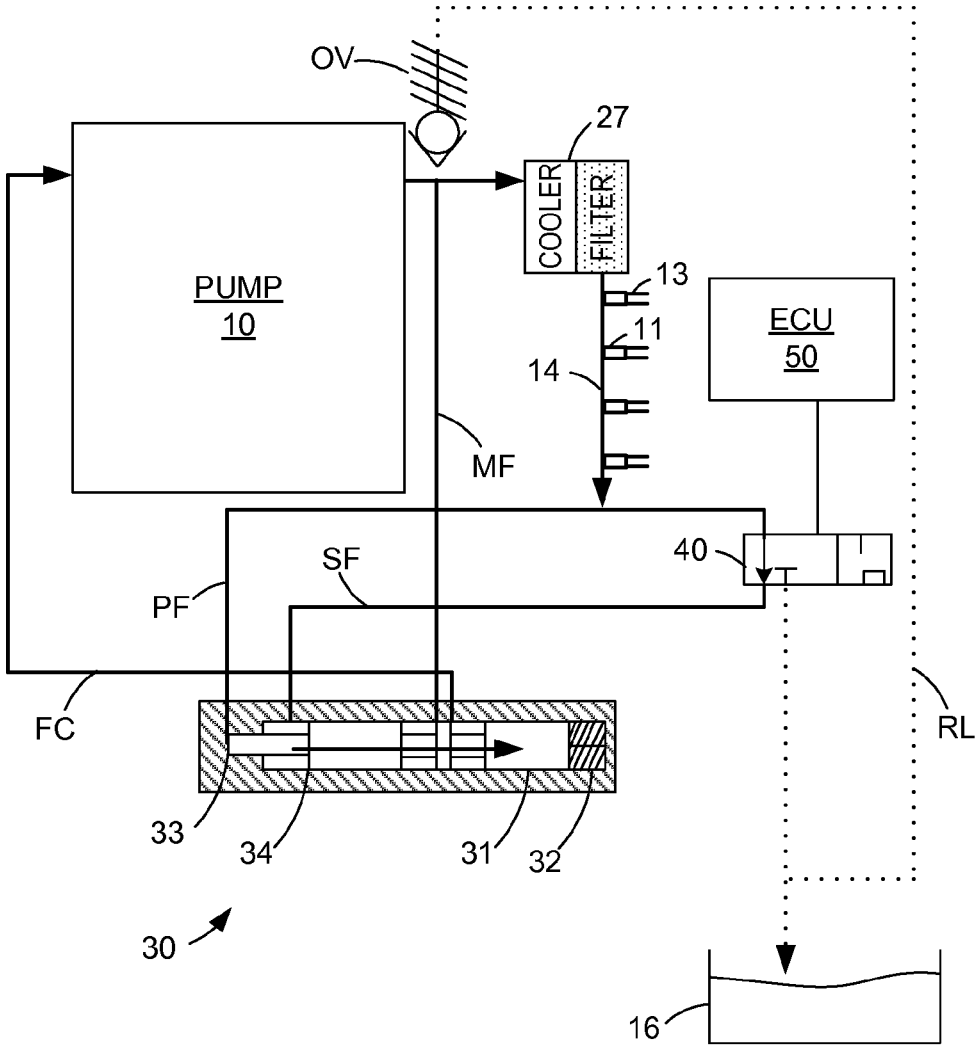
FIG. 5 is a schematic diagram of an oil supply system showing an embodiment of the system in a low pressure operating mode.
Figure 6:
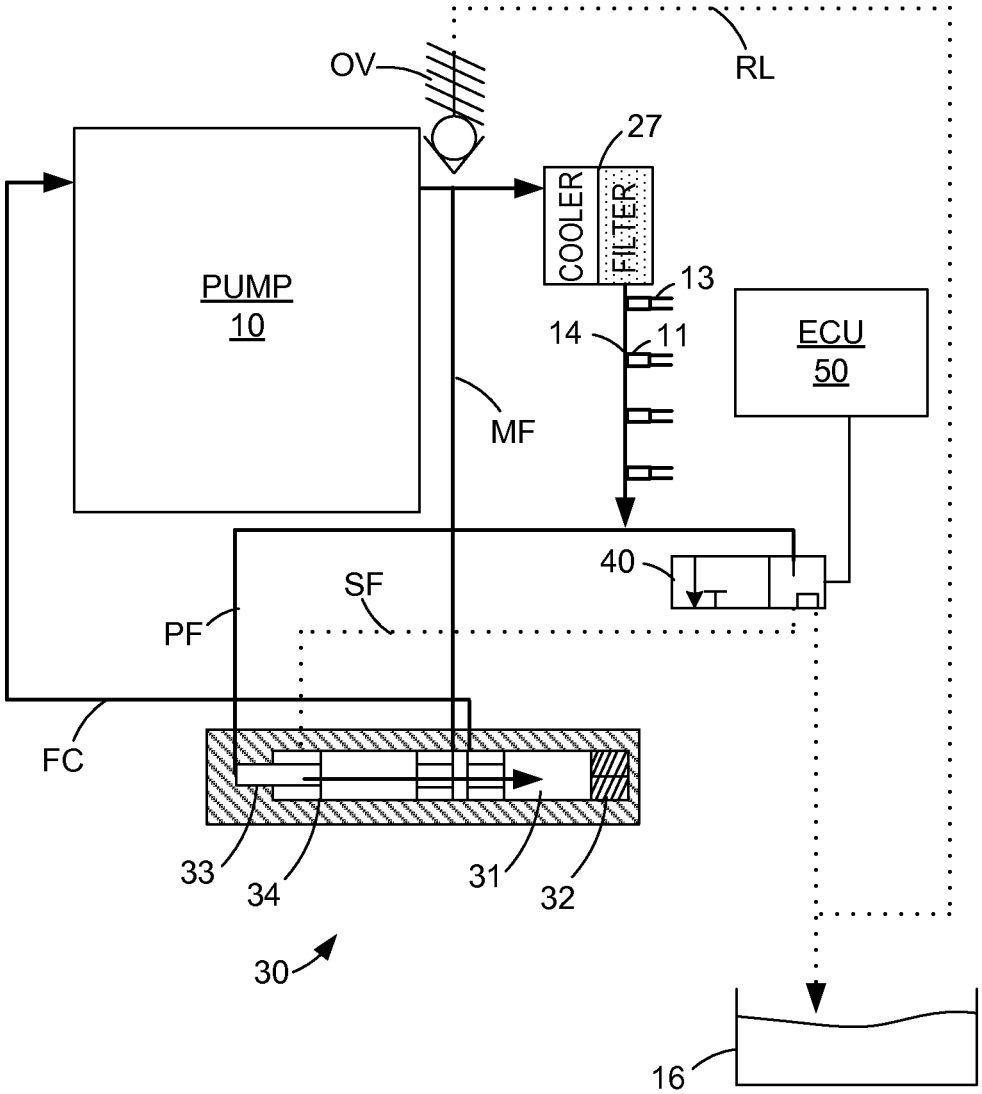
FIG. 6 is a schematic diagram of the oil supply system shown in FIG. 5 but showing the system in a high pressure operating mode.

Referring now in particular to FIGS. 5 and 6 the connection of the pump 10 to other parts of the oil supply system is shown in a schematic form. FIG. 5 shows the oil supply system operating in the low pressure mode, while FIG. 6 shows the oil supply system operating in the high pressure mode. The pressure feedback port 10*f* of the pump 10 is connected via a feedback conduit 'FC' to the output from a spool valve 30. The spool valve 30 includes a spool member 31 slidingly supported in a cylindrical chamber which may be formed as part of the housing of the pump 10 or may be a separate housing. The spool member 31 has a first small diameter portion 33 and a second larger diameter portion 34 and is biased to the left as shown by a spring 32. The small diameter portion 33 is connected via an inlet port to a primary feedback supply 'PF' which is permanently connected directly to the main oil galley 14. The larger diameter portion 34 is connected via a second inlet port to a secondary feedback supply 'SF' which is connected to a solenoid operated valve 40. The solenoid operated valve 40 is controlled by an electronic control unit 50 in response to logic contained therein. The ECU 50 receives a number of inputs indicative of the current operating state of the engine 5 including inputs from which the current engine speed and engine loading can be deduced. The solenoid valve 40 is also connected to the main oil galley 14 and is operable to control the flow of oil from the main oil galley 14 to the secondary feedback supply 'SF'. The spool valve 30 is also connected directly to an output from the pump 10 via a main feed 'MF'. In the example shown oil from the pump 10 flows to the main oil galley 14 through a combined oil cooler and filter 27, however, in some embodiments, the cooler and filter may be separate.

Figure 7:
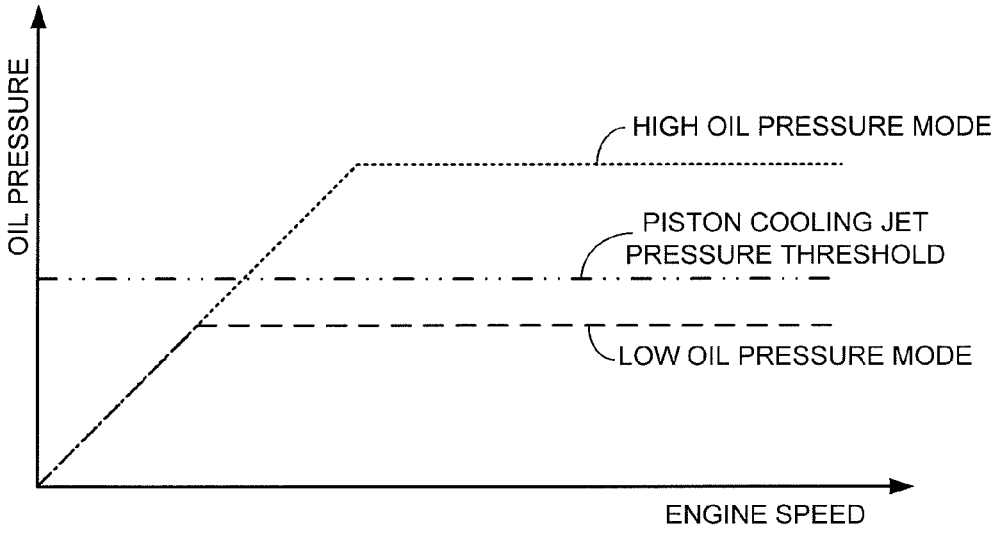
FIG. 7 is a chart showing example operating characteristics of the variable flow oil pump for a range of engine operating speeds indicating the relationship between the pressure produced and a pre-defined valve opening pressure.

As shown in FIG. 6, when the ECU 50 determines, based upon the inputs it receives, that the combination of engine speed and engine load is such that piston cooling is required (as depicted in FIG. 7), the ECU 50 operates the solenoid valve so as to prevent oil from flowing from the main galley 14 through the secondary feedback supply 'SF' to act upon the larger diameter portion 34 of the spool member 31. The only pressure now acting on the spool member 31 is the pressure acting on the smaller diameter portion 33 due to the oil from the primary feedback supply 'PF'. This pressure produces a force of sufficient magnitude so the spool member 31 is displaced against the action of the spring 32 when a high pressure is available in the main galley 14 and hence permits a feedback to the pump 10 via the feedback conduit 'FC' from the main feed 'MF'. This has the effect of increasing the flow rate of the pump 10 so that it operates in a high pressure mode and the pressure in the oil supply circuit is then regulated to this high pressure which is above the opening pressure of the pressure operated valves 11.

However, as shown in FIG. 5, when the ECU 50 determines, based upon the inputs it receives, that the combination of engine speed and engine load is such that no piston cooling is required, it operates the solenoid valve 40 so as to permit oil to flow from the main galley 14 through the secondary feedback supply 'SF' to act upon the larger diameter portion 34 of the spool member 31. The combination of the pressure acting on the larger diameter portion 34 and the pressure acting on the smaller diameter portion 33 due to the oil from the primary feedback supply 'PF' produces a force of sufficient magnitude so the spool member 31 is displaced by a great distance against the action of the spring 32, when a low pressure is available in the main galley 14. Hence the spool valve member 31 is displaced against the action of the spring 32 so as to provide a low pressure feedback to the pump 10 via the feedback conduit 'FC' from the main feed 'MF'. This has the effect of reducing the flow rate of the pump 10 so that it operates in a low pressure mode and the pressure in the oil supply circuit is then regulated to this low pressure which is below the opening pressure of the pressure operated valves 11.

Thus, the operating mode of the pump may be controlled by the electronic control unit by means of the solenoid valve. The solenoid valve may control the flow of oil to the spool valve used to control the operating mode of the pump by means of hydraulic feedback. One advantage of the present disclosure is that, if a failure occurs, for example, a failure of one or more inputs to the ECU 50 or failure of the solenoid 40 to respond correctly to the control of ECU 50, then the system will default, hydraulically, to the "high pressure mode". The solenoid valve 40 may operate in the position shown in FIG. 6, that is the position where the secondary feedback line SF is blocked from the main galley 14, by default, and operate in the position where the main galley 14 is able to supply oil to the secondary feedback line SF only in response to a signal sent from the ECU 50. Thus, if the ECU 50 fails to send a signal to the solenoid valve 40, or the solenoid valve 40 fails to respond to a signal sent from the ECU 50, the pump 10 will operate in the high pressure mode. In this way, piston cooling can be ensured in response to degradation of the ECU 50 and/or degradation of the solenoid valve 40.

Figure 8:
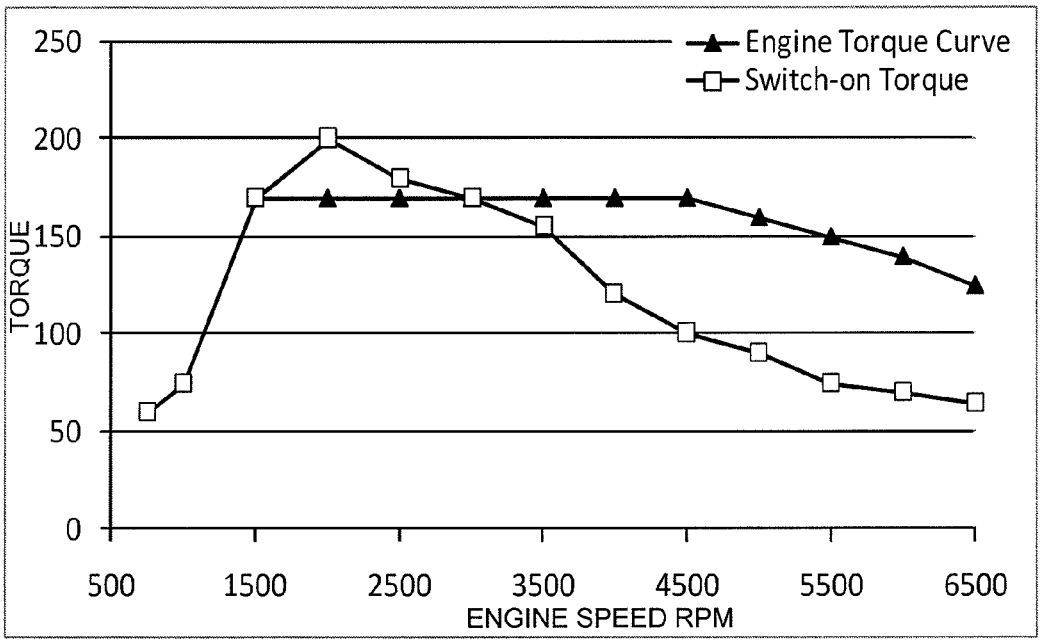
FIG. 8 is a chart showing an example relationship between engine output torque and engine speed and piston cooling switch-on torque versus engine speed.
Figure 9:
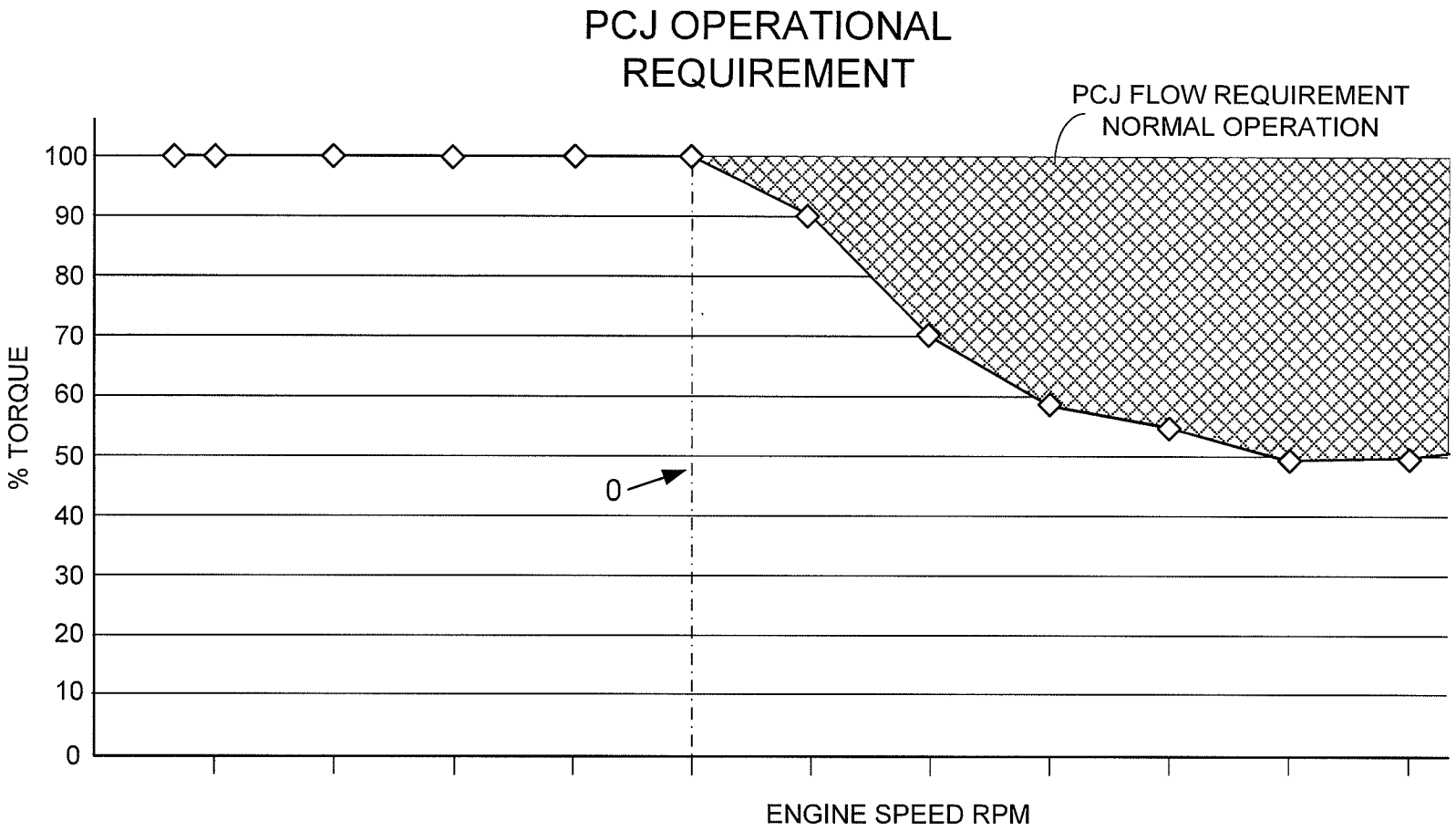
FIG. 9 is a chart showing an example control envelope for piston cooling based upon engine speed and % Torque Output from the engine.
Figure 10:
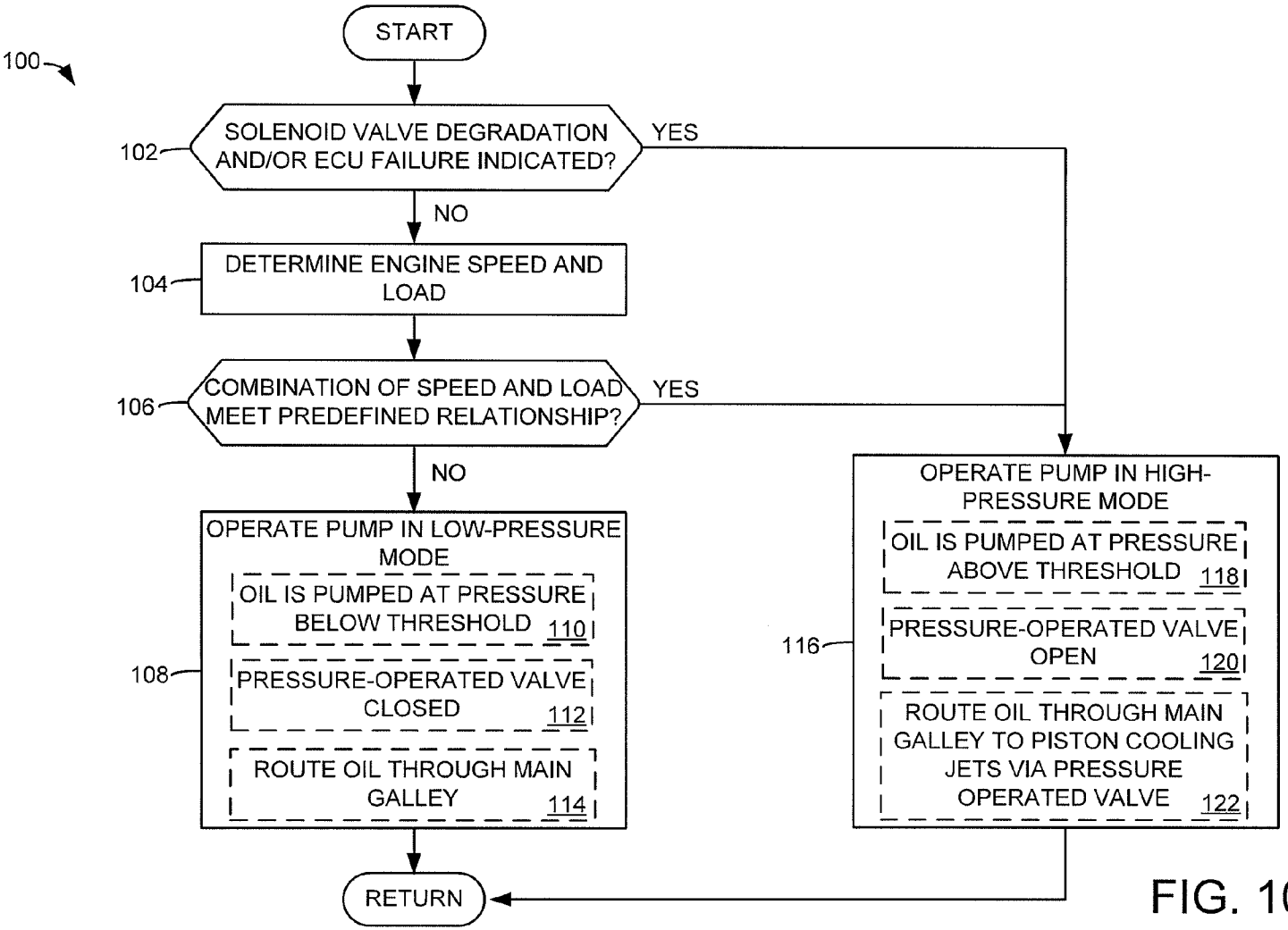
FIG. 10 is a flow chart illustrating an example method for controlling oil flow in an engine.

Referring now to FIGS. 8 and 9 the control methodology of the ECU 50 will be explained in greater detail. From dynamometer test work a torque curve for the engine 5 can be derived as shown by the triangle indexed curve on FIG. 8. From piston thermal testing it can be determined when piston cooling is indicated at engine torque values relative to engine speed indicated by the square indexed curve on FIG. 8. The above curves are translated into an engine speed/torque map showing where piston cooling is indicated as indicated in FIG. 9. The ECU 50 uses this map to determine whether the oil pressure may be set above the piston cooling jet threshold pressure shown on FIG. 7 (predefined valve opening pressure) and will supply power to the solenoid valve 40 appropriately.

It will be appreciated that in FIG. 9 the % Torque is a measure of the load on the engine 5 and so the opening of the pressure operated valves 11 is dependent on a predefined relationship between engine load and engine operating speed. It will be appreciated that various parameters could be used as an indication of engine load. For example, the actual torque supplied by the engine 5 could be directly measured using a torque sensor and the signal from this sensor fed to the ECU 50. Alternatively, the load on the engine 5 could be deduced from other engine parameters, such as throttle pedal position, or could be derived from data used to control the fueling of the engine 5. The engine load may be a measure of the percentage torque produced by the engine relative to the maximum torque output of the engine.

For the example shown in FIG. 9, no piston cooling is provided when the engine speed is less than a lower limiting value '0' (in this case 2500 RPM) irrespective of the load on the engine 5, but above the engine speed '0' the determination of whether piston cooling is indicated is based on a combination of engine speed and load on the engine 5.

In general terms the value of engine load where piston cooling is required reduces as the engine speed increases above the lower limiting value '0' and so, for the example shown, at or near maximum engine speed piston cooling will be switched on when the level of engine load is greater than 50% but at the lower limiting value of engine speed '0', an engine load of 100% is required to cause piston cooling to be switched on. The shaded area on FIG. 9 shows the combinations of engine speed and load where piston cooling is supplied according to one example embodiment of the present disclosure.

Thus, if the speed of the engine is below a lower limiting value, the low pressure mode of operation may be selected irrespective of the engine load. When the speed of the engine is above the low limiting value and the combination of speed and load is above a predefined level, the pump may be operated in the high pressure mode. Further, when the engine speed is above the lower limiting value, the pump may be operated in the high pressure mode based on an inverse relationship between speed and load. For example, when the engine speed is at the lower limiting value an engine load of 100% may be required to cause the pump to be operated in the high pressure mode. Additionally, when the engine speed is at or near the maximum engine speed of the engine an engine load of greater than 50% may be required to cause the pump to be operated in the high pressure mode.

Turning to FIG. 10, a method 100 for controlling oil flow in an engine is shown. Method 100 may be carried out by an engine control unit, such as ECU 50, in order to provide cooling to one or pistons of engine 5. Method 100 comprises, at 102, determining if a solenoid valve coupled to an oil pump, such as solenoid valve 40 and pump 10, is degraded and/or if ECU failure is indicated. Solenoid valve degradation may be indicated by the valve being unresponsive to a signal sent from the ECU, or any suitable mechanism. If the answer to the question at 102 is yes, and degradation and/or failure is indicated, the solenoid valve operates in its default mode and as a result, method 100 proceeds to 116 to operate the pump in the high pressure mode.

However, if the answer at 102 is no and failure or degradation is not indicated, method 100 proceeds to 104 to determine engine speed and load. Engine speed and load may be determined from signals received at the control unit from various sensors within engine 5. At 106, it is determined if the combination of engine speed and load meets a predefined relationship. The predefined relationship may be defined by an engine speed-load map held in the memory of the control unit. The map may be accessed and current engine speed and load, as determined at 104, entered into the map. If the current engine speed and load fall within a predefined area on the map, such as the shaded area depicted in FIG. 9, the speed and load meet the predefined relationship. If the answer to the question at 106 is no, method 100 proceeds to 108 to operate an oil pump in a low-pressure mode. During the low-pressure mode, the oil pump pumps oil through an oil galley at an oil pressure that is below a threshold at 110. A pressure-operated valve coupled to the oil galley is configured to open when oil pressure is above a threshold. Thus, due to the low pressure of the oil, the pressure-operated valve is closed at 112. As a result of the oil pump operating in the low pressure mode, oil is routed through the oil galley at 114 and is blocked from the pressure-operated valve.

If the answer to the question at 106 is yes and it is determined engine speed and load do meet a predefined relationship, method 100 proceeds to 116 to operate the pump in the high pressure mode. During the high-pressure mode, the oil pump pumps oil through an oil galley at an oil pressure that is above the threshold at 118. As described above, the pressure-operated valve coupled to the oil galley is configured to open when oil pressure is above a threshold. Thus, due to the high pressure of the oil, the pressure-operated valve is open at 120. As a result of the oil pump operating in the high pressure mode, oil is routed through the oil galley to a piston cooling jet via the pressure operated valve at 122. As a result, the piston cooling jet may supply oil to a piston in order to cool the piston.

It will be appreciated by those skilled in the art that although a description has been provided by way of example with reference to one or more embodiments, it is not limited to the disclosed embodiments and that one or more modifications to the disclosed embodiments or alternative embodiments could be constructed without departing from the scope of the disclosure as set out in the appended claims.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method in an engine, comprising:

adjusting, responsive to engine speed, oil pressure inversely with engine speed by adjusting a solenoid valve, wherein adjusting the solenoid valve comprises, in a low-pressure mode of operation of a variable flow rate oil pump, adjusting the solenoid to hydraulically couple an oil galley with a first inlet of a spool valve via a secondary feedback supply, to permit oil flow from the oil galley to the first inlet of the spool valve, wherein an outlet of the spool valve is hydraulically coupled with an inlet of the variable flow rate oil pump and a second inlet of the spool valve is permanently hydraulically coupled with the oil galley via a primary feedback supply; and in a high-pressure mode of operation of the variable flow rate oil pump, adjusting the solenoid to block oil flow from the oil galley to the first inlet of the spool valve;

selectively routing oil through the oil galley to a piston cooling jet via a pressure-operated valve responsive to the adjusted oil pressure; and responsive to identified degradation of the solenoid valve, increasing the oil pressure irrespective of engine speed to supply oil cooling jet operation, wherein a position of the solenoid valve is adjusted to operate the variable flow rate oil pump in the low-pressure mode irrespective of engine load when engine speed is below a lower limiting value.

2. The method of claim 1, wherein the selective routing includes blocking flow to the piston cooling jet at low engine loads and speeds.

3. The method of claim 1, wherein in the low-pressure mode, oil is pumped to the oil galley at a pressure below a threshold, and in the high-pressure mode, oil is pumped to the oil galley at a pressure above the threshold, and wherein the pressure-operated valve coupled to the piston cooling jet is configured to open at oil pressures equal to or greater than the threshold.

4. An engine having an oil supply system as claimed in claim 1.

5. The method of claim 3, wherein the position of the solenoid valve is adjusted to operate the variable flow rate oil pump in the high-pressure mode when engine speed is above the lower limiting value and further based on an inverse relationship between engine speed and load.

6. The method of claim 3, wherein the position of the solenoid valve is adjusted to operate the variable flow rate oil pump in the high-pressure mode when engine speed is at the lower limiting value and engine load is at 100%, and to operate the variable flow rate oil pump in the high-pressure mode when engine speed is at or near maximum engine speed and engine load is greater than 50%.

7. A method for cooling a piston of an engine, comprising:

controlling a position of a solenoid valve hydraulically coupled to a first inlet of a spool valve to operate a variable flow rate oil pump in either a low-pressure mode or a high-pressure mode based on engine speed and engine load, including controlling the position of the solenoid valve to operate the variable flow rate oil pump in the low-pressure mode irrespective of engine load if engine speed is below a lower limiting value, the solenoid valve permitting oil flow from an oil galley to the first inlet of the spool valve via a secondary feedback supply during the low-pressure mode and blocking oil flow from the oil galley to the first inlet of the spool valve during the high-pressure mode, a second inlet of the spool valve permanently hydraulically coupled with the oil galley via a primary feedback supply, and an outlet of the spool valve hydraulically coupled to an inlet of the variable flow rate oil pump, the solenoid valve having a default position wherein oil flow in the secondary feedback supply is blocked and the variable flow rate oil pump is operated in the high-pressure mode;

pumping oil from the oil galley to a piston cooling jet via a pressure-operated valve when the variable flow rate oil pump is operating in the high-pressure mode, the piston cooling jet configured to supply the piston with oil to cool the piston; and pumping oil through the oil galley and blocking the piston cooling jet when the variable flow rate oil pump is operating in the low-pressure mode.

8. The method of claim 7, wherein the position of the solenoid valve is based on a predefined relationship between engine speed and load.

9. The method of claim 7, wherein the pressure-operated valve is configured to open in response to oil pressure in the oil galley being above a threshold, and wherein operating the variable flow rate oil pump at the high pressure mode further comprises pumping oil at a pressure above the threshold and wherein operating the variable flow rate oil pump at the low-pressure mode further comprises pumping oil at a pressure below the threshold.

10. An oil supply system for a reciprocating piston internal combustion engine, the system comprising:

an electronic control unit;

an oil reservoir;

a variable flow rate pump to supply oil at pressure from the reservoir to components including at least one piston cooling jet hydraulically coupled to an oil galley and requiring a supply of oil;

a spool valve having an outlet hydraulically coupled to an inlet of the pump, a solenoid valve permitting oil flow from the oil galley to a first inlet of the spool valve, via a secondary feedback supply in a low-pressure mode of operation of the variable flow rate pump and blocking oil flow in the secondary feedback supply in a high-pressure mode of operation of the variable flow rate pump, and a second inlet of the spool valve permanently hydraulically coupled with the oil galley via a primary feedback supply; and at least one pressure-operated valve to supply oil from the oil galley to the at least one piston cooling jet, each pressure-operated valve coupled to one piston cooling jet and configured to open at a pre-defined valve opening pressure, wherein the variable flow rate pump is operable to supply oil in the low-pressure mode of operation at a first pre-defined pressure below the pre-defined valve opening pressure and to supply oil in the high-pressure mode of operation at a second pre-defined pressure above the pre-defined valve opening pressure, wherein the electronic control unit is operable to select either the low-pressure or the high-pressure mode of operation of the variable flow rate pump based upon a predefined relationship between engine speed and engine load, and wherein if engine speed is below a lower limiting value, the low-pressure mode of operation of the variable flow rate pump is selected irrespective of engine load.

11. The system of claim 10, wherein the variable flow rate pump is operated in the high-pressure mode when engine speed is above the lower limiting value and a combination of engine speed and engine load is above a predefined level.

12. The system of claim 11, wherein the engine load is a measure of a percentage of torque produced by the engine relative to a maximum torque output of the engine.

13. The system of claim 12, wherein the variable flow rate pump is operated in the high-pressure mode when engine speed is at the lower limiting value and engine load is at 100%.

14. The system of claim 12, wherein the variable flow rate pump is operated in the high-pressure mode when engine speed is at or near maximum engine speed and engine load is greater than 50%.

15. The system of claim 10, wherein the operating mode of the variable flow rate pump is controlled by the electronic control unit by means of a solenoid valve.

16. The system of claim 15, wherein the solenoid valve controls a flow of oil to the spool valve used to control the operating mode of the variable flow rate pump by means of hydraulic feedback via the secondary feedback supply.

17. The system of claim 16, wherein in response to a failure of the solenoid valve or the electronic control unit, oil does not flow in the secondary feedback supply and oil does flow in the primary feedback supply, such that the variable flow rate pump operates in the high-pressure mode.

18. The system of claim 10, wherein each piston of the engine has at least one pressure-operated valve coupled with at least one cooling jet.

* * * * *